US010994399B2

(12) United States Patent
Duggan

(10) Patent No.: US 10,994,399 B2
(45) Date of Patent: May 4, 2021

(54) HAMMER DRILL AND SET TOOL DEVICE

(71) Applicant: Ryan Duggan, Cedar Rapids, IA (US)

(72) Inventor: Ryan Duggan, Cedar Rapids, IA (US)

( * ) Notice: Subject to any disclaimer, the term of this patent is extended or adjusted under 35 U.S.C. 154(b) by 86 days.

(21) Appl. No.: 16/045,388

(22) Filed: Jul. 25, 2018

(65) Prior Publication Data

US 2019/0030701 A1 Jan. 31, 2019

Related U.S. Application Data

(60) Provisional application No. 62/539,074, filed on Jul. 31, 2017.

(51) Int. Cl.
*B25D 16/00* (2006.01)
*B25D 11/12* (2006.01)
*B25D 17/08* (2006.01)

(52) U.S. Cl.
CPC ..... *B25D 16/006* (2013.01); *B25D 11/125* (2013.01); *B25D 17/08* (2013.01); *B25D 2211/003* (2013.01); *B25D 2216/0015* (2013.01); *B25D 2216/0023* (2013.01); *B25D 2216/0038* (2013.01); *B25D 2250/245* (2013.01)

(58) Field of Classification Search
CPC ..... B25D 2216/0023; B25D 16/006; B25D 11/125
USPC ..... 173/51; 408/35, 16
See application file for complete search history.

(56) References Cited

U.S. PATENT DOCUMENTS 2,303,565 A * 12/1942 Luna ..... B23B 45/02 173/214
3,056,441 A * 10/1962 Helms ..... B25B 23/00 81/429
6,506,002 B1 * 1/2003 Cummins ..... B23B 39/205 408/124
6,668,941 B2 * 12/2003 Phillips ..... B25B 23/005 173/29
7,661,485 B2 2/2010 Vogele et al.
7,997,835 B2 * 8/2011 Whitehead ..... B23B 39/205 408/16
10,220,497 B2 * 3/2019 Vandenberg ..... B25B 21/002
2003/0165365 A1 * 9/2003 Eriksen ..... B23B 45/003 408/35
2004/0074653 A1 4/2004 Hashimoto et al.
2006/0137888 A1 6/2006 Soika et al.
2007/0098507 A1 * 5/2007 Whitehead ..... B25F 3/00 408/35
2009/0010725 A1 * 1/2009 Egelund ..... B23B 39/205 408/35
2009/0022557 A1 * 1/2009 Whitehead ..... B23B 39/205 408/35

* cited by examiner

*Primary Examiner* — Robert F Long
*Assistant Examiner* — Xavier A Madison
(74) *Attorney, Agent, or Firm* — Shuttleworth & Ingersoll PLC; Brett D. Papendick

(57) ABSTRACT

A power tool that can switch from a hammer drill to a set tool for placing anchors in a surface such as concrete. Changing from a rotating drill to set tool bits is done by a two finger snap lock handle on the top of the drill. A magazine attachable to the power tool contains a plurality of anchors allowing the user of the power tool to set more than one anchor without having to manually place each anchor in the power tool.

15 Claims, 5 Drawing Sheets

HAMMER DRILL AND SET TOOL DEVICE

CROSS-REFERENCE TO RELATED APPLICATIONS

The present application claims priority to provisional patent application 62/539,074 which was filed on Jul. 31, 2017, and is hereby expressly incorporated by reference in its entirety.

BACKGROUND OF THE INVENTION

Concrete fasteners, such as lead anchors and drop-ins, are typically set in concrete using three separate types of tools. Those tools include a hammer drill, a setting tool and a hammer. First, a person must drill a hole to a predetermined depth using the hammer drill. Second, the person must then put down the hammer drill and pick up the setting tool. The concrete fastener is then placed on the setting tool. Lastly, the person must then grab the hammer to set the anchor in the hole drilled by the hammer drill. At times, additional tools are required such as channel locks to remove the set tool. The invention described herein allows a person to accomplish the three steps in one tool allowing installations to go faster. In addition to saving time, the invention allows costs related to capital and labor to decrease.

SUMMARY OF THE INVENTION

The invention is a device that allows the functionality of a hammer drill along with the functionality of a set tool. The device has a typical hammer bit, but in addition has a set tool facing downward. The set tool has a threaded portion that is fitted on to an anchor. The device also includes a push button feeder to place anchors onto the set bit. Once an anchor is placed on the set tool, a user simply rotates the set tool upward into a position where the hammer function of the hammer drill to set the anchor. In order to remove the set tool from the anchor, the user simply uses the drill function of the device and reverses out leaving the anchor in place within the surface. The set tool is then pushed back down into its first position and the next hole can be drilled.

The anchors are fed through a side mounted magazine with a load assist lever to ease loading and relieve spring tension. Loading of the anchors is done by opening a feed door on the front of the magazine on a side of the device. In order to ensure smooth operation and the loading of one anchor at a time, a slide-out door and gear for single lead loads into the set tool chute. The chute places anchors in an exact fit puck that is interchangeable for different size anchors.

Changing from a rotating drill to set tool is done by a two finger snap lock handle on the top of the drill. The two finger snap lock handle also functions as a trigger break switch to prevent drill movement while rotating from the drill functions to the set tool functions and vice versa. The slide function breaks and remakes the drive into each drill bit.

The set tool has a quick release function similar to impact drills for easy change out to different size anchor sets (for example, ¼", ⅜", ½", etc.) there is a threaded handle hole on either side of the device for left or right hand operation to aid drilling and/or setting. Magazines for anchors can be designed as a one type fit all or snap and lock in place change out for different sizes. The use of multiple magazines could be used for even faster installations.

The overall purpose of the invention is to speed up construction by having an anchor, a set tool, and a hammer within an all-in-one device without having to utilize, pickup and set down separate tools. The device allows a user to drill and set multiple anchors with one device in a fraction of the time of the prior art. As an example, hanging one light for an electrician requires drilling two holes with a hammer drill; setting down the hammer drill; threading an anchor onto a set tool; picking up a hammer while holding the set tool; and then repeating for the second hole. With the invention, hanging one light can be done faster with everything in one device. Accordingly, a new warehouse job with one thousand lights could be done with one person going through and drilling holes without every setting down the drill while a coworker works hanging the lights behind him. This device will dramatically speed up installations for many tradesmen, including electricians, plumbers, pipefitters, tinners, and ironworkers. In addition, the invention can include a set tool bit that can be fit into one of the chucks described herein.

DETAILED DESCRIPTION OF THE INVENTION

Figure 1:
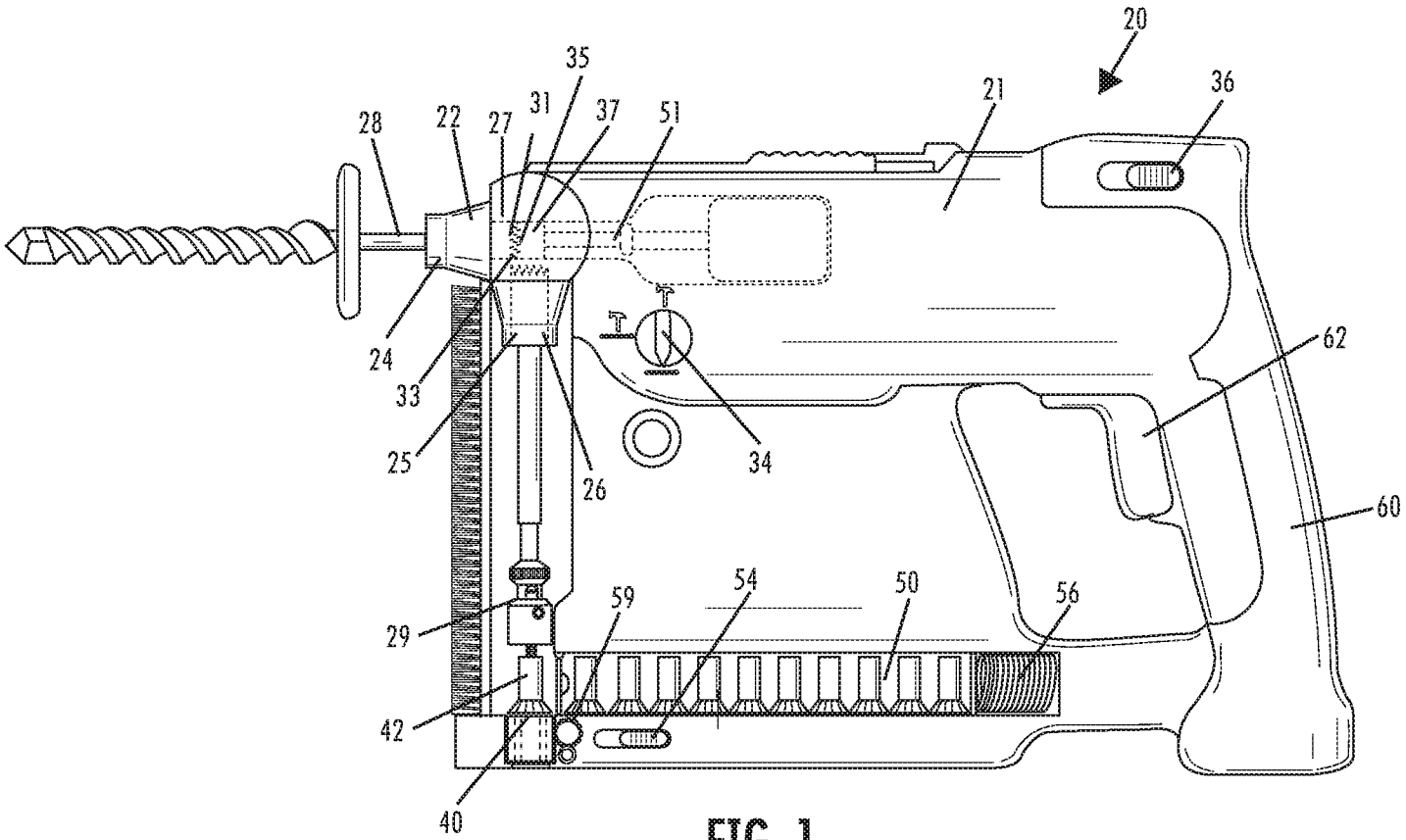
FIG. 1 shows a side view of the invention in a first position.
Figure 2:
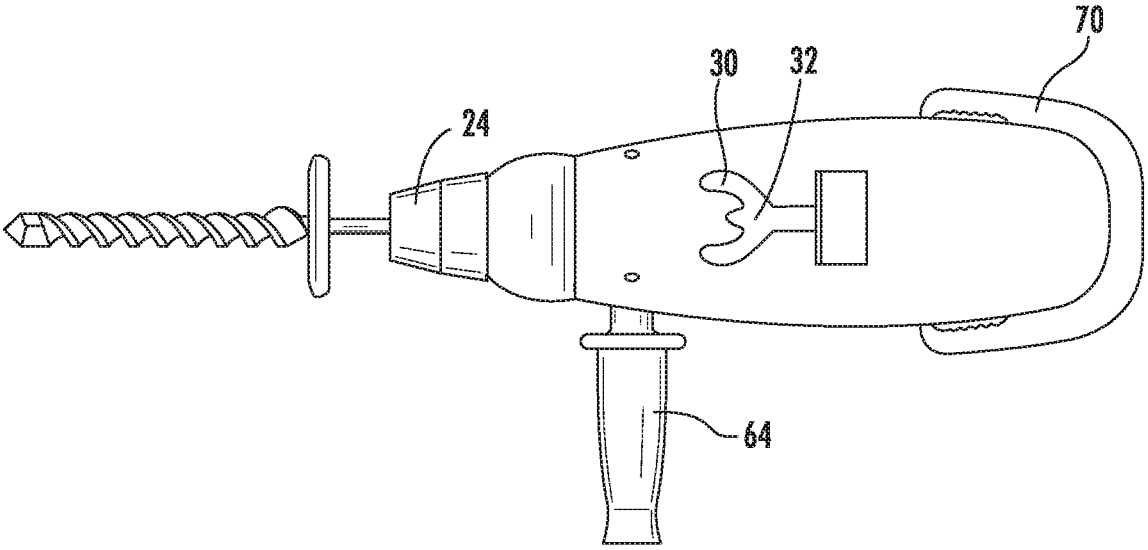
FIG. 2 shows a top view of the invention in the first position.
Figure 3:
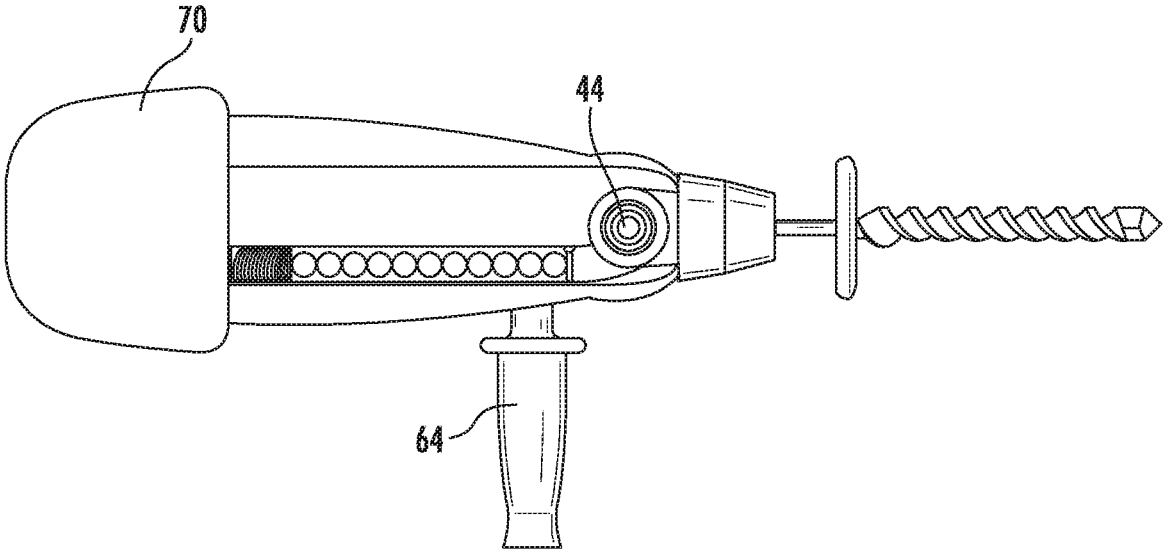
FIG. 3 shows a bottom view of the invention in the first position.

Now referring to the drawings, FIGS. 1-7 show a power tool 20 having the functionality of a hammer drill and a setting tool. The power tool 20 has a main body 21 and a first rotating head 22. The first rotating head 22 has a first chuck 24, that is preferably a scroll chuck or a three jaw chuck. The first chuck 24 is capable of receiving a standard drill bit 28. A second rotating head 25 has a second chuck 26. Similar to the first chuck 24, the second chuck 26 also preferably is a scroll chuck or three jaw chuck. The second chuck 26 is capable of receiving a set tool 29 that has been modified to be secured by the second chuck 26. See FIGS. 4 and 5 for the set tool being modified to a set tool bit 100. The first chuck 24 is connected to a first connecting shaft 27 that is connected to a base shaft 37 as shown in FIG. 1. The base shaft 37 is driven rotationally directly or indirectly by means of a motor, which in turn will rotationally drive the first connecting shaft 27. At a first end 31 of the first connecting shaft 27, a plurality of gear teeth 33 can mesh with a plurality of gear teeth 35 on an end of the base shaft 37.

Figure 7:
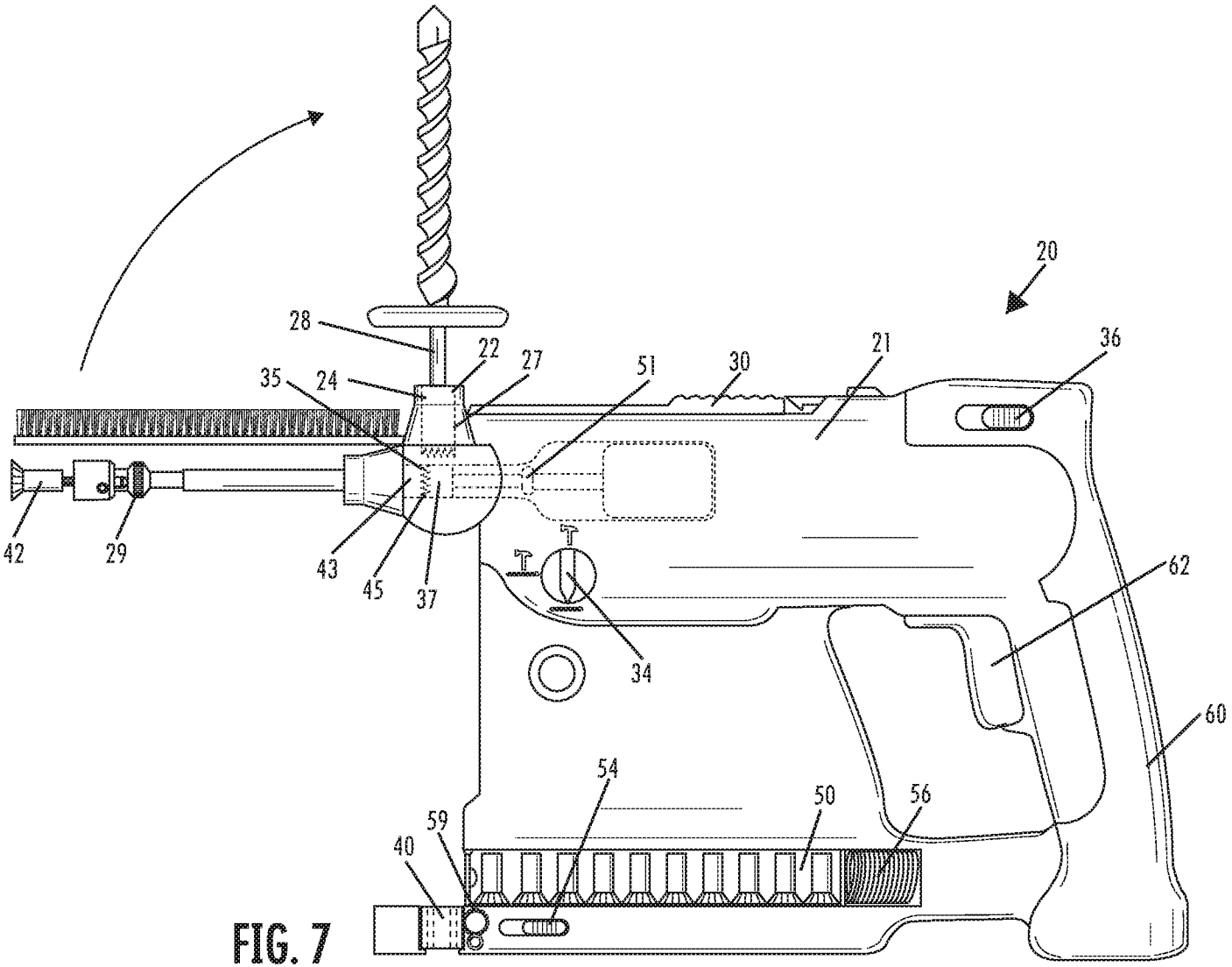
FIG. 7 shows a side view of the invention in the second position.

The connection between the first connecting shaft 27 and the base shaft 37 can be disengaged by actuating a first switch 30 which can be a shaft slide back lever. The first switch 30 is preferably located on a top 32 of the tool 20. The first switch 30 has a first position and a second position. The first position allows the applicable rotating head 22 or 25 to rotate. The second position of the first switch 30 allows the applicable rotating head 22 or 25 to be moved manually in order to change between the rotating heads 22 and 25. Additionally, the second position of the first switch 30 prevents power being supplied to the base shaft 37, therefore acting as a trigger break. Preferably, the first switch 30 is a two-finger snap lock handle. Once the first connecting shaft 27 is disengaged from the base shaft 37, the second chuck 26 and the set tool 29 in the second chuck 26 can be rotated upward such that a second connecting shaft 43 and its plurality of gear teeth 45 can mesh with the plurality of gear teeth 35 on the end of the base shaft 37. In the preferred embodiment, the second chuck 26 and the second connecting shaft 43 are rotated ninety degrees upward in order to change from the first rotating head 22 to the second rotating head 25 being rotatable by the base shaft 37. The first switch 30, a shaft slide back lever, is then actuated in an opposite direction to secure the engagement of the second connecting shaft 43 and the base shaft 37. As shown in FIG. 1, the first rotating head 22 is engaged with the base shaft 37 via the first connecting shaft 27, accordingly the power tool 20 is operating as a drill. The tool 20 operating with the first rotating head 22 is a first position, while the tool 20 operating with the second rotating head 24 is a second position. FIG. 7 shows the second rotating head 25 engaged with the base shaft 37 via the second connecting shaft 43, accordingly the power tool 20 is operating with the second rotating head 25, which preferably be connected to a set tool.

A second switch 34 controls the hammer and drill functions of the power tool 20. The hammer function is powered by a piston 51 and the piston 51 is independent of the rotation of either the first connecting shaft 27 or the second connecting shaft 43. Accordingly, the hammer function remains available regardless of which connecting shaft is in communication with the base shaft. Furthermore, the hammer function can be used independently of the drill function or in combination with the drill function. A first position of the second switch 34 allows the power tool 20 to have both hammer and drill functions. A second position of the second switch 34 allows the power tool 20 to operate only in the hammer function. A third position of the second switch 34 allows the power tool 20 to operate only in the drill function. In the preferred embodiment, a user of the tool 20, manually rotates the second switch 34 to move from the different positions associated with the second switch 34.

A third switch 36 in a first position allows the user to select clockwise movement of the first rotating head 22 or second rotating head 25. A second position of the switch 36 allows the user to select counter clockwise movement of the first rotating head 22 or second rotating head 25. A third position of the third switch 36 prevents rotation of the first rotating head 22 or second rotating head 25. These functions controlled by the second switch 34 and the third switch 36 are well known in the art.

The power tool 20 comprises a loading platform 40 that can hold one anchor 42 such that the anchor 42 is in a position to be fed onto the set tool 29. The loading platform 40 is movable from a first position to a second position in a vertical plane. The loading platform 40 has a plurality of cylindrical channels 57 and is preferably cylindrically channeled or tapered to accommodate anchors of different diameters. An actuator 44 in the form of a push button can be pushed manually by the user to lift the loading platform 40 vertically. Once raised to the second position, a motor 46 is engaged and rotates the loading platform 40, and thus the anchor 42, such that the anchor 42 is threaded onto the set tool 29. A series of gears 59 is configured to rotate the loading platform 40.

The power tool 20 preferably includes a magazine 50 that can hold a plurality of anchors 42. The user of the power tool 20 can utilize a lever 54 to trigger a magazine spring 56 to push the next anchor 42 into place on the loading platform 40. A door closes once an anchor is loaded on the loading platform to help prevent jamming of the device due to more than one anchor being fed onto the loading platform.

The power tool 20 has a first handle 60 for a user to put one of their hands on and hold the tool 20. The other hand of the user can be place on a second handle 64 that can be placed on either side of the main body 21. A trigger 62 is depressed by a finger of the user to activate one of the functions controlled by the second switch 34. Power to the power tool 20 is supplied by a rechargeable battery 70, but could be powered by other known means such as gas or through an electric cord plugged into an electrical source.

Figure 4:
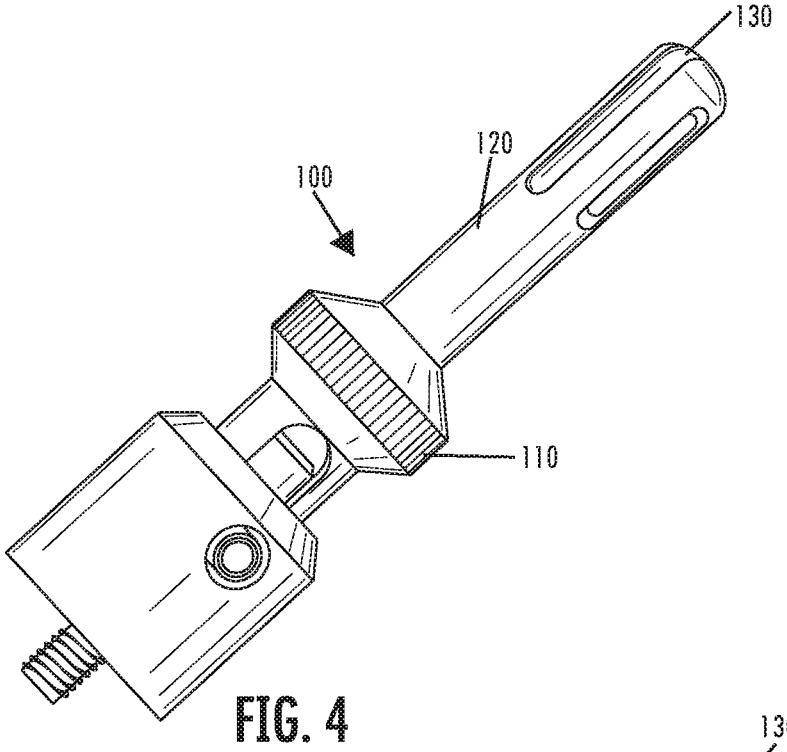
FIG. 4 shows a perspective view of the set tool bit.
Figure 5:
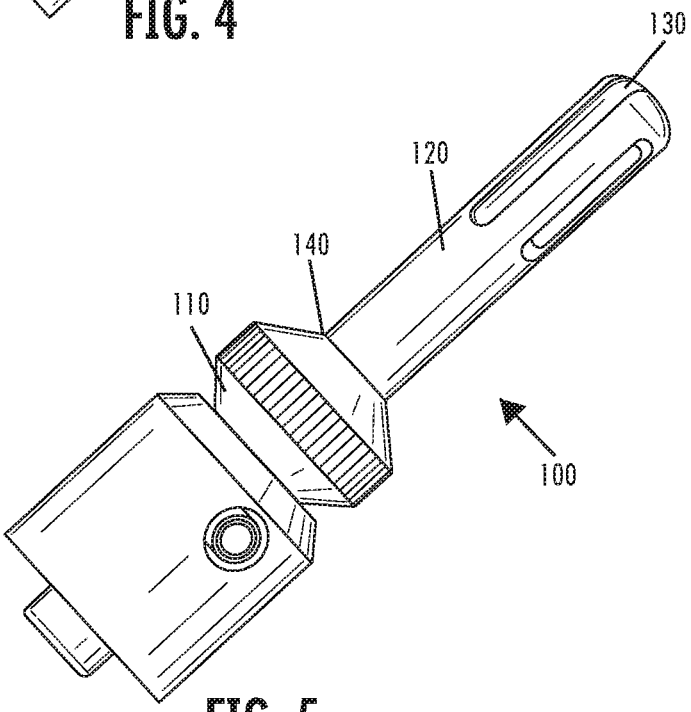
FIG. 5 shows a second perspective view of the set tool bit.
Figure 6:
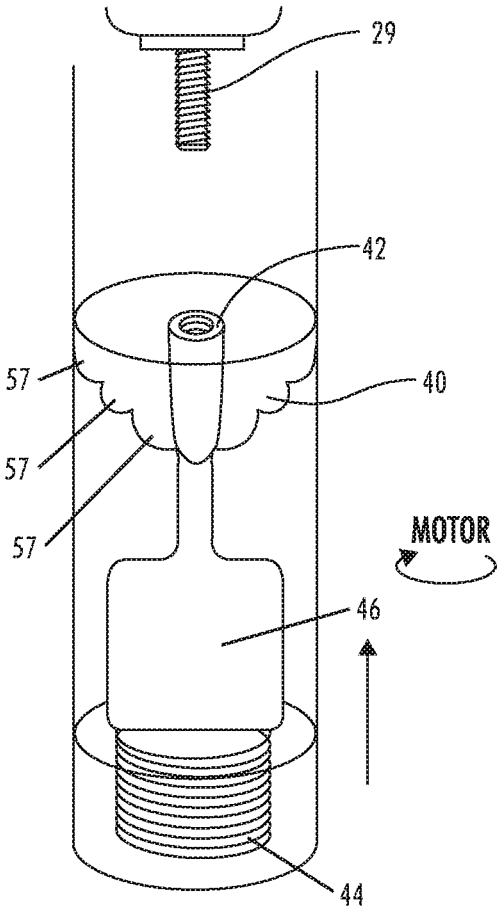
FIG. 6 shows a front view of the loading mechanism.

While drill bits are well known, the use of a set tool on a bit is novel. As shown in FIGS. 4 and 5, a set tool bit 100 is detailed. The set tool bit 100 comprises a setting tool 110 such as a screw anchor expander and a first shaft 120. The first shaft 120 comprises grooves 130 that will be held by a power tool such as a drill, hammer drill, or the power tool 20 described herein above. The first shaft 120 is attached to a first end 140 of the setting tool 110. The setting tool 110 can be a screw anchor expander, which has a second shaft comprising a first end and a second end. The second end of the second shaft acts as a bearing surface to force the anchor into a desired position while using a hammer drill or hammer. Any type of known set tools could be used as the setting tool 110 and be attached to the first shaft 120 in order to construct the correct set tool bit 100 for a particular job.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A power tool, comprising:

a first rotating head;

a second rotating head;

a base shaft;

a first connecting shaft;

a second connecting shaft;

the first rotating head configured to receive a drill bit;

the second rotating head configured to receive a set tool;

the base shaft configured to be rotated by a motor;

the power tool has a first position and a second position;

the first position connects the first connecting shaft to the base shaft;

wherein the rotation of the base shaft rotates the first connecting shaft and the first rotating head;

the second position connects the second connecting shaft to the base shaft;

wherein the rotation of the base shaft rotates the second connecting shaft and the second rotating head;

a loading platform configured to hold an anchor;

the loading platform movable from a first position to a second position;

wherein the anchor is loadable on to the set tool in the second position of the loading platform.

2. The power tool of claim 1, further comprising:

a motor configured to rotate at least a portion of the loading platform to thread the anchor onto a threaded portion of the anchor.

3. The power tool of claim 2, further comprising:
a plurality of anchors;
the plurality of anchors are held within a magazine;
the magazine selectively attachable to a main body of the power tool.

4. The power tool of claim 3, wherein:
the motor is a button motor.

5. The power tool of claim 4, further comprising:
a spring that assists in the loading of an anchor on to the loading platform.

6. The power tool of claim 5, wherein:
the loading platform comprises a plurality of cylindrical channels configured to accommodate anchors of various sizes and circumferences.

7. The power tool of claim 6, further comprising:
a first switch;
the first switch selectively engages or disengages the base shaft from the first connecting shaft or the second connecting shaft;
a second switch;
the second switch having at least three positions;
a first position of the second switch allowing the device to have both hammer and drill functions;
the second position of the second switch allowing the device to have only hammer functions;
the third position of the second switch allowing the device to have only drill functions.

8. The power tool of claim 7, further comprising:
a third switch;
the third switch having a first position and a second position;
the first position allowing clockwise movement of either the hammer drill or the set tool;
the second position allowing counter-clockwise movement of either the hammer drill or the set tool.

9. The power tool of claim 8, wherein:
the spring is biased against the plurality of anchors.

10. The power tool of claim 9 wherein:
the loading platform comprises gears configured to rotate one anchor on the set tool.

11. The power tool of claim 10, wherein:
the first switch is a two finger snap and lock changing handle.

12. The power tool of claim 11, further comprising:
at least one handle selectively attachable to the main body.

13. A power tool for drilling holes and setting anchors, comprising:
a first rotating head;
the rotating head having a first chuck adapted to secure a drill bit;
a second rotating head;
the second rotating head having a second chuck adapted to secure a set tool bit;
a base shaft;
a first connecting shaft;
a second connecting shaft;
the first rotating head configured to receive a drill bit;
the second rotating head configured to receive a set tool;
the base shaft configured to be rotated by a motor;
the power tool has a first position and a second position;
the first position connects the first connecting shaft to the base shaft;
wherein the rotation of the base shaft rotates the first connecting shaft and the first rotating head;
the second position connects the second connecting shaft to the base shaft;
wherein the rotation of the base shaft rotates the second connecting shaft and the second rotating head;
a loading platform configured to hold an anchor;
the loading platform movable from a first position to a second position;
wherein the anchor is loadable on to the set tool in the second position of the loading platform.

14. The power tool of claim 13, further comprising:
a motor configured to rotate at least a portion of the loading platform to thread the anchor onto a threaded portion of the anchor.

15. The power tool of claim 14, further comprising:
a plurality of anchors;
the plurality of anchors are held within a magazine;
the magazine selectively attachable to a main body of the power tool.

* * * * *